US008365669B1

(12) United States Patent
Saxby

(10) Patent No.: US 8,365,669 B1
(45) Date of Patent: Feb. 5, 2013

(54) TRAINING CARTRIDGE

(75) Inventor: Michael Ernest Saxby, Eastbourne (GB)

(73) Assignee: UTM IP Limited, Mildenhall (GB)

( * ) Notice: Subject to any disclaimer, the term of this patent is extended or adjusted under 35 U.S.C. 154(b) by 0 days.

(21) Appl. No.: 13/216,897

(22) Filed: Aug. 24, 2011

(51) Int. Cl.
*F42B 5/045* (2006.01)

(52) U.S. Cl. ..... 102/430; 102/444; 102/440; 102/470; 102/469

(58) Field of Classification Search ..... 102/444, 102/430, 446, 498, 448, 521, 529, 469, 470
See application file for complete search history.

(56) References Cited

U.S. PATENT DOCUMENTS

| | | | | |
|---|---|---|---|---|
| 3,618,250 | A * | 11/1971 | Grandy | 102/446 |
| 3,967,552 | A * | 7/1976 | Settles et al. | 102/430 |
| 4,604,954 | A * | 8/1986 | Clarke et al. | 102/434 |
| 4,715,284 | A * | 12/1987 | Hendry et al. | 102/434 |
| 5,016,536 | A * | 5/1991 | Brighton | 102/430 |
| 5,359,937 | A * | 11/1994 | Dittrich | 102/430 |
| 5,492,063 | A * | 2/1996 | Dittrich | 102/430 |
| 5,677,505 | A * | 10/1997 | Dittrich | 102/444 |
| 5,700,972 | A * | 12/1997 | Saxby | 102/440 |
| 5,962,805 | A * | 10/1999 | Saxby | 102/440 |
| 6,095,051 | A * | 8/2000 | Saxby | 102/444 |
| 6,178,889 | B1 * | 1/2001 | Dindl | 102/447 |
| 6,415,718 | B1 * | 7/2002 | Saxby | 102/446 |
| 6,422,149 | B1 * | 7/2002 | Saxby | 102/446 |
| 6,427,600 | B2 * | 8/2002 | Saxby | 102/444 |
| 6,439,123 | B1 * | 8/2002 | Dionne et al. | 102/430 |
| 6,564,719 | B2 | 5/2003 | Saxby | |
| 6,575,098 | B2 * | 6/2003 | Hsiung | 102/498 |
| 7,814,836 | B2 * | 10/2010 | Saxby | 102/444 |
| 2010/0269724 | A1 * | 10/2010 | Head et al. | 102/447 |

FOREIGN PATENT DOCUMENTS

WO WO 9114916 A1 * 10/1991

OTHER PUBLICATIONS

United Kingdom Search Report for Application No. GB0908936.8, dated Aug. 27, 2009.

* cited by examiner

*Primary Examiner* — Jonathan C Weber
(74) *Attorney, Agent, or Firm* — Nelson Mullins Riley & Scarborough LLP; Anthony A. Laurentano

(57) ABSTRACT

A cartridge for non-lethal applications comprises a posterior portion 1 which extends axially to provide a cylindrical casing. An anterior portion comprises of a nose portion 2 with a centrally located recess 8 for receiving a projectile, and an axially extending piston 3 which is slidably engaged in the chamber defined by the cylindrical casing 1. A posterior primer 4 is located to the end of the posterior portion which is most distal to the nose portion 2. An anterior primer 5 sits just behind the recess 8 of the nose portion 2. A plastic striker is located in the chamber defined by the cylindrical casing 1 and comprises of a sealing flange portion 6 and striking nose portion 7. The striking nose portion 7 locates snugly but slidably in a second chamber provided axially within the piston 3. In use, the posterior primer 4 releases gaseous product which drives the striker 7 against the anterior primer 5 while simultaneously causing telescopic extension of the cartridge which in turn results in recycling of a host firearm.

8 Claims, 1 Drawing Sheet

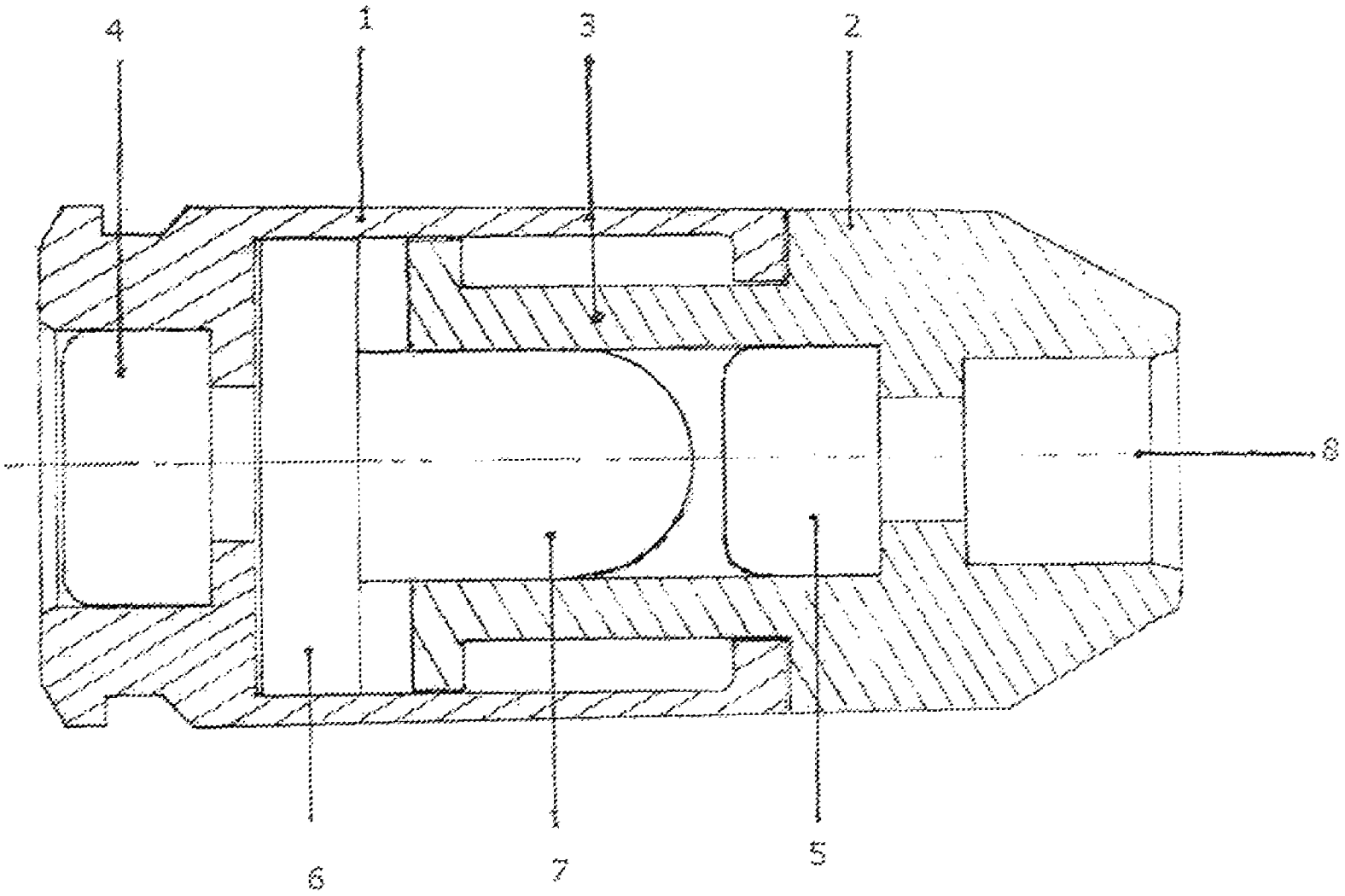
2
3
1
4
5
6
7
8

TRAINING CARTRIDGE

BACKGROUND OF THE INVENTION

This invention relates to training cartridges, most particularly to training cartridges which recycle the host firearm by telescopic expansion of the cartridge.

Telescopically expanding training cartridges are known, one example is described in the applicant's own U.S. Pat. No. 6,564,719 B2. A typical cartridge of the type described in that patent comprises a posterior portion which has a moveable member which is slidable rearwardly towards a breech block of a host firearm. The anterior portion has a gas passage there through and an expansion chamber is provided between the moveable member and the anterior portion. Gas generating means for providing gas within the cartridge are initiatable on firing of the firearm to propel the moveable member in a rearward direction so as to recycle the firearm. A second gas generating means is positioned forward of the gas passage and may be initiated by any suitable reaction caused on initiation of the posterior primer. For example, the shock or pressure wave generated on activation of the primer may be sufficient to initiate the second gas generating means, or alternatively, activation of the posterior primer may activate a secondary mechanical or electrical device which serves to initiate the second gas generating means.

In the above described prior art cartridges hot, high pressure gas from the posterior primer enters all of the major telescopically moving parts of the cartridge. This limits the choice of materials from which any thin section part of the cartridge assembly can be manufactured to metals which have sufficient resistance to these temperatures and pressures. Consequently, the anterior and posterior portions of the telescopically expanding recycling mechanism are made almost entirely of metals.

SUMMARY OF THE INVENTION

The present invention seeks to provide an alternative design of cartridge which provides for the use of alternative materials in the manufacture of the cartridge.

In accordance with the present invention there is provided a cartridge for use in non-lethal applications comprising an anterior portion and a posterior portion, together providing a recycling mechanism including a moveable member in the form of a piston or cylinder, slidably engaged respectively with a cylinder or a piston, a posterior primer located to the rear of the posterior portion for generating gas within the cartridge, the gas generated serving in use to propel the moveable member in a rearward direction against the breech block so as to recycle the firearm, the anterior portion having a gas channel there through and being provided with a nose portion which is suitable for receiving a projectile; an expansion chamber being provided between the moveable member and the anterior portion, an anterior primer located in the anterior portion forward of the gas channel, a percussion means slidably disposed in the gas channel which percussion means is, in use, propelled by gas generated by the posterior primer to strike against the anterior primer causing initiation, thereby to cause propulsion of a projectile from the nose portion and characterized in that the percussion means comprises a striker composed of a plastic material, the striker having a rear flanged portion sealably and slidably disposed in the expansion chamber whereby to prevent gas products generated by the posterior primer from contacting the anterior portion.

Provision of the novel striker makes it possible to provide the anterior portion of the recycling mechanism from a plastic or other material which is less robust than a metal. There are considerable cost savings to be made by the manufacturer if one of the major telescopically moving parts can be made of plastic rather than metal. Mass production of the plastic part is far more cost effective than production of a similar component from metal. Furthermore there is a consequent and beneficial weight reduction in the cartridge which reduces costs of transport.

The plastic striker is used to seal the hot high pressure gas into the metal case and as it moves to expand the cartridge it fires the anterior primer before the telescopic recycling of the cartridge occurs.

The anterior primer does not produce sufficient pressure to damage the plastic components as the release of the projectile from the nose keeps the pressure to a low acceptable level.

A further advantage of the novel cartridge design is that no gas or debris from the fired posterior primer is left in the host firearm or released into the atmosphere near the shooter.

The anterior primer is desirably made from non toxic materials and produces little or no debris.

Plastic materials used for the anterior portion can be colored enabling cartridges for different purposes to be color coded.

The posterior portion is desirably comprised from a brass or steel providing a centre of gravity of the cartridge close to its posterior end. This facilitates efficient live round ejection.

BRIEF DESCRIPTION OF THE DRAWINGS

An embodiment of the invention will now be further described with reference to the accompanying FIGURE.

FIG. 1 shows a longitudinal cross section of a cartridge in accordance with the presently claimed invention.

DETAILED DESCRIPTION

As can be seen from FIG. 1, a cartridge comprises a posterior portion 1 which extends axially to provide a cylindrical casing. An anterior portion comprises of a nose portion 2 with a centrally located recess 8 for receiving a projectile, and an axially extending piston 3 which is slidably engaged in the chamber defined by the cylindrical casing 1. A posterior primer 4 is located to the end of the posterior portion which is most distal to the nose portion 2. An anterior primer 5 sits just behind the recess 8 of the nose portion 2. A plastic striker is located in the chamber defined by the cylindrical casing 1 and comprises of a sealing flange portion 6 and striking nose portion 7. The striking nose portion 7 locates snugly but slidably in a second chamber provided axially within the piston 3.

In use, posterior primer 4 is initiated on firing of a host firearm. Gas product from the posterior primer 4 expands driving the cylindrical casing in a first axial direction and the striker 6, 7 in an opposing, second axial direction. The striking nose portion 7 strikes the anterior primer 5 producing gas product which serves, in use, to propel a projectile (not shown) from the recess 8 in the nose portion 2. Gas product from the posterior primer 4 is contained by the cylindrical casing 1 and sealing flange portion 6. The piston 3 and cylinder 1 move in opposing axial directions telescopically extending the cartridge. Within a host firearm, in use, the base of the posterior portion 1 encounters the breech of the firearm and recycles the firearm.

The posterior portion 1 is manufactured substantially entirely of metal, typically brass or steel. Since the anterior portion 2, 3 is protected from the gaseous product and debris of the posterior primer 4 by sealing flange portion 6, it can be made substantially entirely from a plastic material providing the benefits discussed above.

It will be appreciated that whilst the embodiment illustrates the posterior portion 1 as a cylinder and the anterior portion 2, 3 as a piston, the arrangement could readily be reversed by the skilled addressee without the need to apply inventive thought and without departing from the scope of the invention as claimed.

I claim:

1. A cartridge for a firearm for use in non-lethal applications comprising an anterior portion and a posterior portion, together providing a recycling mechanism including a moveable member in the form of a piston or cylinder, slidably engaged respectively with a cylinder or a piston, a posterior primer located to the rear of the posterior portion for generating gas within the cartridge, the gas generated serving in use to propel the moveable member in a rearward direction against a breech block so as to recycle the firearm, wherein the anterior portion has a gas channel formed therethrough and is provided with a nose portion which is suitable for receiving a projectile, an expansion chamber provided between the moveable member and the anterior portion, an anterior primer located in the anterior portion forward of the gas channel, a percussion element slidably disposed in the gas channel and is propelled, in use, by gas generated by the posterior primer to strike against the anterior primer causing initiation, thereby to cause propulsion of the projectile from the nose portion, said percussion element comprising a striker composed of a plastic material, the striker having a rear flanged portion sealably and slidably disposed in the expansion chamber to prevent gas products generated by the posterior primer from contacting the anterior portion.

2. A cartridge as claimed in claim 1, wherein the anterior portion is formed from a plastic material.

3. A cartridge as claimed in claim 2, wherein the plastic material is colored consistent with a color coding scheme for identifying the proper application of the cartridge.

4. A cartridge as claimed in claim 1, wherein the posterior portion is made of steel.

5. A cartridge as claimed in claim 1, wherein the posterior portion is made of brass.

6. A cartridge as claimed in claim 1, wherein the posterior portion provides a cylinder and the anterior portion provides a piston slidable axially in the cylinder of the posterior portion.

7. A cartridge as claimed in claim 1, further comprising a projectile disposed in a recess of the nose portion of the anterior portion.

8. A combination of a cartridge as claimed in claim 1 and a host firearm, the host firearm being configured for firing the cartridge.

* * * * *